US011185750B2

(12) United States Patent
ViaCava

(10) Patent No.: US 11,185,750 B2
(45) **Date of Patent: *Nov. 30, 2021**

(54) SPORTS TRAINING DEVICE AND METHODS OF USE

(71) Applicant: Neal ViaCava, Washington Crossing, PA (US)

(72) Inventor: Neal ViaCava, Washington Crossing, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/940,480

(22) Filed: Jul. 28, 2020

(65) Prior Publication Data

US 2020/0353335 A1 Nov. 12, 2020

Related U.S. Application Data

(63) Continuation of application No. 16/250,050, filed on Jan. 17, 2019, now Pat. No. 10,758,802.

(60) Provisional application No. 62/685,533, filed on Jun. 15, 2018.

(51) Int. Cl.

| | |
|---|---|
| ***A63B 69/00*** | (2006.01) |
| ***A63B 63/04*** | (2006.01) |
| ***A63B 63/00*** | (2006.01) |

(52) U.S. Cl.

CPC ..... *A63B 69/002* (2013.01); *A63B 63/004* (2013.01); *A63B 2063/002* (2013.01); *A63B 2210/50* (2013.01); *A63B 2243/0025* (2013.01)

(58) Field of Classification Search

CPC ..... A63B 63/004; A63B 63/00; A63B 69/00; A63B 69/002; A63B 69/0024; A63B 69/0026; A63B 71/00; A63B 71/022; A63B 2243/025; A63B 2210/50; A63B 2063/002

See application file for complete search history.

(56) References Cited

U.S. PATENT DOCUMENTS

| | | | | | |
|---|---|---|---|---|---|
| 3,408,071 | A * | 10/1968 | Lundy | A63B 71/022 | 473/421 |
| 4,169,598 | A * | 10/1979 | Taylor | A63B 63/004 | 273/127 B |
| 5,205,564 | A * | 4/1993 | Lamberti | A63B 63/004 | 273/400 |
| 5,564,711 | A * | 10/1996 | Scheie | A63B 61/00 | 273/400 |
| 6,849,009 | B1 * | 2/2005 | Forlini | A63B 71/022 | 473/446 |
| 6,899,645 | B1 * | 5/2005 | Hsiao | A63B 63/004 | 273/400 |
| 8,460,128 | B2 * | 6/2013 | Elpers | A63B 63/00 | 473/431 |
| 10,758,802 | B2 * | 9/2020 | ViaCava | A63B 69/002 | |
| 2003/0119611 | A1 * | 6/2003 | Lytle | A63B 69/0097 | 473/434 |

(Continued)

*Primary Examiner* — Raleigh W Chiu

(74) *Attorney, Agent, or Firm* — Wei & Sleman LLP

(57) ABSTRACT

A training device for use with a goal having a pair of posts and a crossbar, includes a pair of side panels, each side panel being disposed adjacent each of the pair of posts, each side panel including a pair of first arms disposed parallel with the pair of posts, upper and lower transverse members extending between the pair of first arms, a first netting covering the area defined by the pair of first arms, and the upper and lower transverse members, and at least one hinge coupling one of the first arms to an adjacent post.

9 Claims, 5 Drawing Sheets

(56) References Cited

U.S. PATENT DOCUMENTS

| | | | | |
|---|---|---|---|---|
| 2006/0091610 | A1* | 5/2006 | Williams | A63B 71/022 273/398 |
| 2009/0209372 | A1* | 8/2009 | Rigoli | A63B 71/022 473/435 |
| 2010/0069178 | A1* | 3/2010 | Plut | A63B 71/022 473/435 |
| 2010/0120558 | A1* | 5/2010 | Conforti | A63B 71/022 473/435 |
| 2010/0317467 | A1* | 12/2010 | Freynhofer | A63B 63/004 473/478 |
| 2013/0190109 | A1* | 7/2013 | Rigoli | A63B 63/00 473/478 |
| 2015/0024877 | A1* | 1/2015 | Cowan | A63B 63/004 473/478 |
| 2017/0173431 | A1* | 6/2017 | Rigoli | A63B 63/004 |
| 2018/0185724 | A1* | 7/2018 | Lalaoua | A63B 71/0622 |
| 2019/0381381 | A1* | 12/2019 | ViaCava | A63B 1/00 |

* cited by examiner

SPORTS TRAINING DEVICE AND METHODS OF USE

CROSS-REFERENCE TO RELATED APPLICATIONS

This application is a continuation of U.S. patent application Ser. No. 16/250,050, filed Jan. 17, 2019, entitled "SPORTS TRAINING DEVICE AND METHODS OF USE," and claims priority to U.S. Provisional Application Ser. No. 62/685,533, filed Jun. 15, 2018, entitled "SPORTS TRAINING DEVICE AND METHODS OF USE," the contents of which are fully incorporated as if fully set forth herein.

FIELD OF THE DISCLOSURE

The present disclosure relates to equipment for use in sports, such as the game of soccer (internationally "football"). More particularly, the present disclosure relates to training devices to be used with goals during practice and shooting exercises.

BACKGROUND OF THE DISCLOSURE

In its simplest configuration, a soccer goal typically consists of a pair of upright goalposts, often referred to simply as "posts," a horizontal crossbar extending between the two posts, and a netting stretched between the posts and extending from the crossbar to the ground. A standard soccer goal is 24 feet in width, the lower edge of the crossbar extending 8 feet above the ground. The posts and crossbar are typically between 4-5 inches in thickness. Other sizes for the goals are available for young adults, children and indoor soccer.

Kicking the ball to score in soccer is a skill that needs to be sharpened over time with repetition and practice. This includes penalty kicks, free kicks, and other situations. Amateurs and pros alike will often miss, kicking the ball off-goal, and causing the ball to sail over the crossbar or outside the posts. Because there is nothing to stop the ball from traveling a great distance, this often results in long delays in which the player must go to retrieve the ball, wasting both time and energy of the player. Alternatively, teams are forced to purchase a large number of soccer balls for practice and waste time and energy collecting the balls and taking inventory after practice. Moreover, this problem decreases enjoyment, practice time and player development.

It would be helpful to provide a training device that blocks off-target shots from leaving the field of play and/or preventing balls from entering the goal to prevent wasted time in retrieving it. It will be understood that similar problems arise with other sports, such as hockey and lacrosse, and that the instant disclosure includes device, methods and systems that are equally applicable to other such sports that utilize goals.

SUMMARY OF THE DISCLOSURE

A training device for use with a soccer goal having a pair of posts and a crossbar, includes a pair of side panels, each side panel being disposed adjacent each of the pair of posts, each side panel including a pair of first arms disposed parallel with the pair of posts, upper and lower transverse members extending between the pair of first arms, a first netting covering the area defined by the pair of first arms, and the upper and lower transverse members, and at least one hinge coupling one of the first arms to an adjacent post.

BRIEF DESCRIPTION OF THE DISCLOSURE

Various embodiments of the presently disclosed training devices are disclosed herein with reference to the drawings, wherein.

Figure 1:
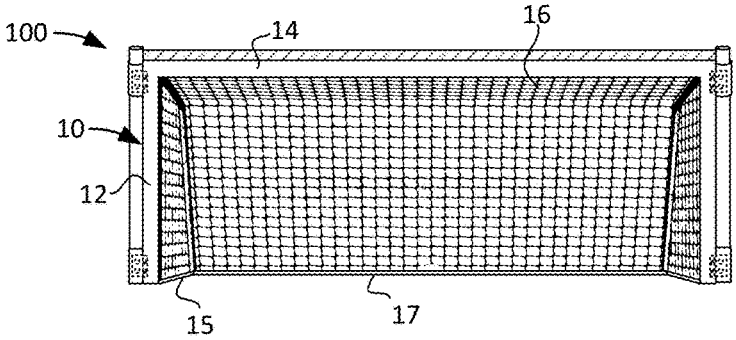
FIG. 1 is a schematic front view of a soccer goal having the training device attached thereto in the collapsed condition in accordance with one embodiment of the disclosure.
Figure 2:
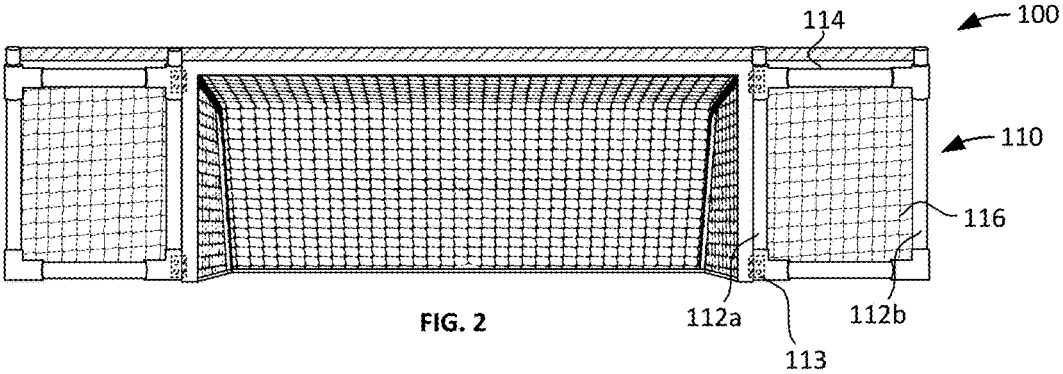
FIG. 2 is a schematic front view of the soccer goal and training device of FIG. 1 in the partially expanded condition.
Figure 3:
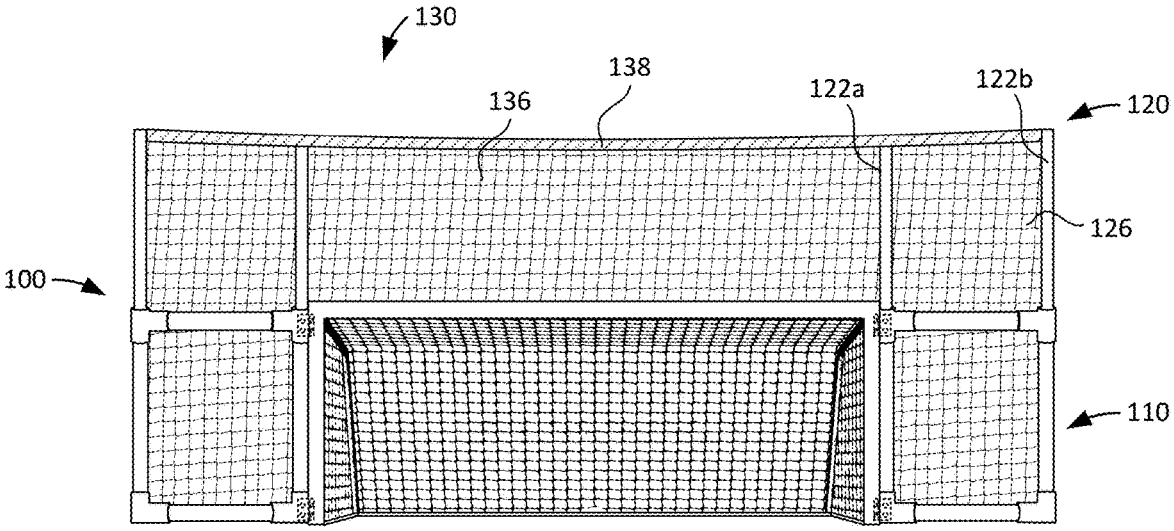
FIG. 3 is a schematic front view of the soccer goal and training device of FIG. 1 in its fully expanded condition.
Figure 4A:
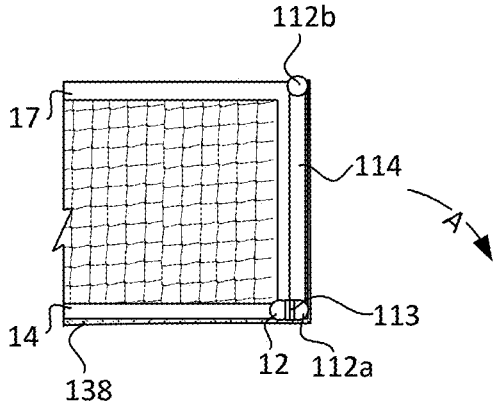
Figure 4B:
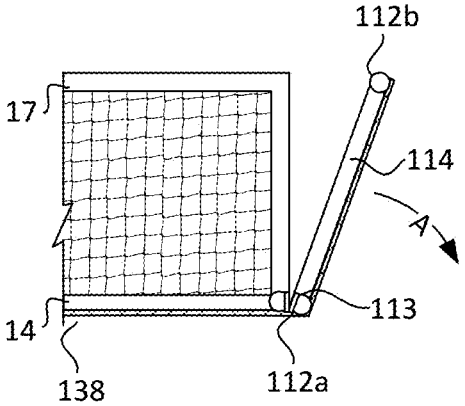
Figure 4C:
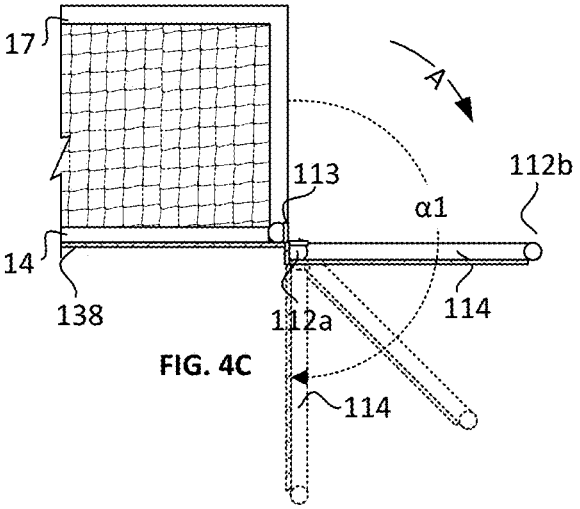
Figure 5:
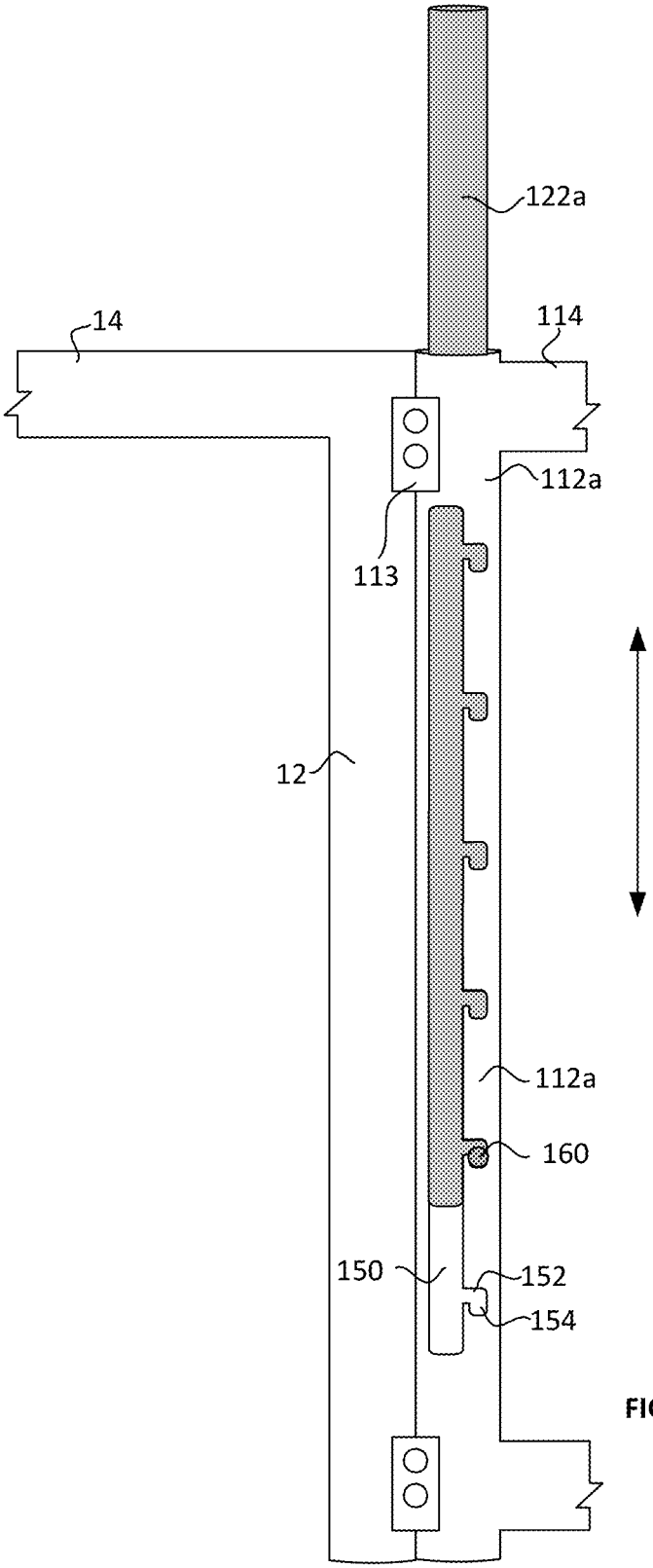
Figure 6A:
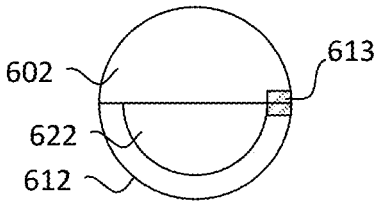
Figure 6B:
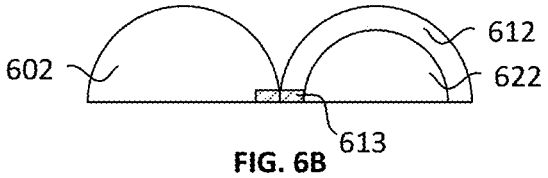
Figure 7A:
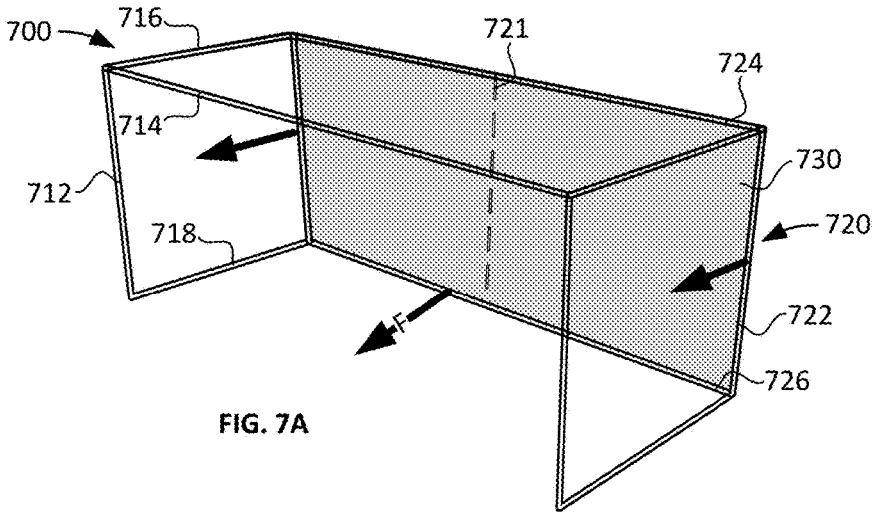
Figure 7B:
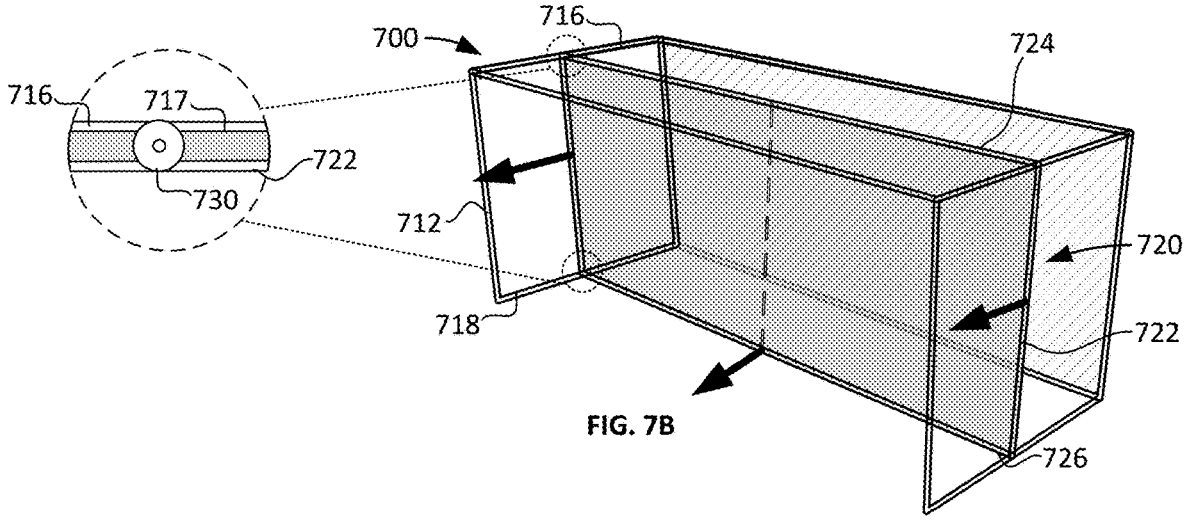
Figure 7C:
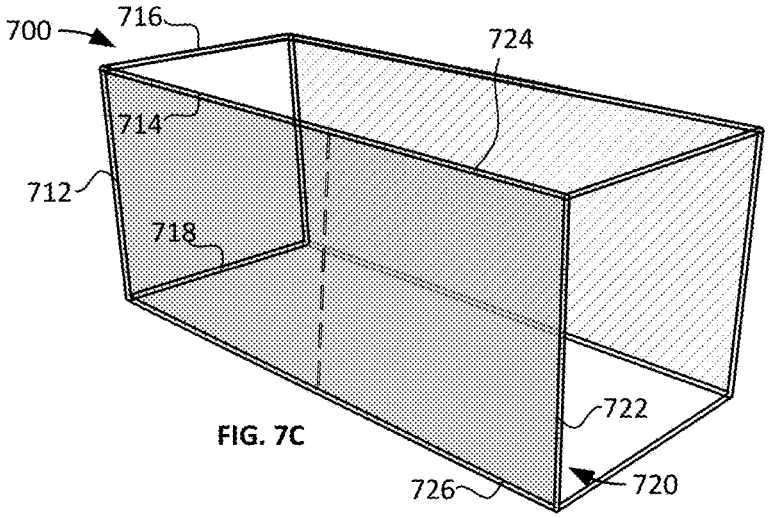

FIGS. 4A-C are schematic top views of the training device of FIGS. 1-3 showing the expansion of the side panels;

FIG. 5 is a schematic partial back view of a telescoping mechanism in accordance with one embodiment of the disclosure;

FIGS. 6A-B are schematic top views of another embodiment of a combined post-arm configuration in the collapsed and expanded conditions; and FIGS. 7A-C are schematic perspective views of a soccer goal having a moveable rear panel being disposed in various positions.

Various embodiments of the present invention will now be described with reference to the appended drawings. It is to be appreciated that these drawings depict only some embodiments of the invention and are therefore not to be considered limiting of its scope.

DETAILED DESCRIPTION

Despite the various improvements that have been made to soccer training equipment, conventional methods suffer from some shortcomings as discussed above.

There therefore is a need for further improvements to the soccer training devices and their methods of use. Among other advantages, the present disclosure may satisfy one or more of these needs.

FIG. 1 illustrates a training device 100 permanently or removably attached to a goal 10. Goal 10 generally includes a pair of upright goalposts 12 and a crossbar 14 extending horizontally between the two posts. In some examples, as shown, the goal 10 includes a rear base 17 and a number of framing elements 15 that attach the posts to the base, and the base to the crossbar. As previously noted, a standard soccer goal is 24 feet in width (i.e., the distance from one post to the other), the lower edge of the crossbar extending 8 feet above the ground. The goalposts and the crossbar may be made of wood, metal or plastic or other suitable material and may have a cross-section that is square, elliptical or round with a thickness of 3-8 inches. Other sizes for the goals are available for young adults, children and indoor soccer, and the training device may be configured and arranged to work with goals of different sizes. A netting 16 extends between the posts and is typically attached to the posts 12, the cross-bar 14, the framing elements 15 and the base 17 to capture a ball that is kicked inside the goal.

As shown in FIG. 1, a training device 100 may be coupled to the goal 10, the training device being in the fully collapsed condition. In some examples, the training device 100 is slightly offset from the goal so that it does not interfere with play when collapsed. By offset, it is meant that the elements of the training device 100 are disposed at least 4 to 10 inches behind the front of the goal so at not interfere with game play when not in use. This may be done by providing suitable hinges that space the training device from the field of play. Portions of the training device 100 will be described sequentially as the device transitions from the collapsed condition, to the partially expanded condition to the fully expanded condition as shown in FIGS. 1-3.

In the partially expanded condition shown in FIG. 2, only side panels 110 of training device 100 are expanded. Each side panel 110 is attached to an adjacent post 12 of goal 10. Each side panel 110 may include a pair of first arms 112*a*, 112*b* that are vertically disposed, parallel with the posts 12. First arms may be made of metal, wood, polyvinyl chloride or other suitable plastics and materials. In at least some examples, first arms are formed of the same material as the posts. Additionally, it will be understood that other elements of the training device (e.g., second arms, transverse members, etc.) may be formed of the same or different materials as the first arm. First arm 112*a* may be coupled to post 12 via a pair of hinges 113, a portion of the hinge being attached to a portion of the first arm 112*a* (e.g., the back of the first arm), and a second portion of the hinge being attached to a side of post 12 so that the side panel is capable of transitioning from a collapsed condition that is perpendicular to crossbar 14 to an expanded condition that is parallel with crossbar 14. It will be understood that one hinge or three or more hinges may be used to couple each side panel to an adjacent post. Additionally, hinges 113 may be lockable in a number of positions so that the angle of the side panels with respect to the goal may be set and fixed. Moreover, a system using rods inserted into the ground surface or other suitable means, such as weighted components may be employed, to secure the panels in place.

Extending between first arms 112*a*,112*b* are transverse members 114 so that the four elements forming the side panel 110 define an effective blocking area (e.g., a square or a rectangle). In at least some examples, side panel 110 has a height equal to the height of the goal (e.g., 8 feet), and a width of 5 to 10 feet. A netting 116 is coupled to first arms 112 and transverse members 114 so that shots that travel outside of post 12 are effectively blocked by the side panels.

Training device 100 includes two side panels 110. Each of the side panels 110 may be actuated separately so that either one or both of the side panels are pivotable to the expanded position from the collapsed condition. Alternatively, the side panels may be connected so that they are openable in unison. Additionally, spring-loaded components, pistons, cable systems, mechanized systems (e.g., hydraulic), flexible materials (e.g., fiberglass, metals, plastics or combinations of the above) or other suitable mechanisms may be used to open and close the panels.

In the fully expanded condition (FIG. 3), additional panels of the device are expanded. First, each of first arms 112*a*, 112*b* may be hollow and capable of housing second arms 122*a*,122*b* that are disposed therein. First and second arms may be concentric, and second arms may be telescopically moveable and extendable from within first arms. The specifics of one expansion mechanism will be described in greater detail with reference to FIG. 5. When second arms 122*a*,122*b* extend out of the first arms, they present two corner panels 120 disposed above side panels 110. In at least some examples, corner panels 120 may be between 4 feet and 10 feet in height and 4 feet and 10 feet in width. In at least some examples, corner panels 120 are the same size as the side panels. All panels may include a mechanism for angling them with respect to the goal and/or the playing field. Corner panels 120 may include netting 126 extending between the second arms. In at least some examples, netting 116 and netting 126 are continuous and formed of the same threads or web. Alternatively, nettings 116 and 126 are separately formed.

Disposed between corner panels 120 is a center panel 130 having netting 136 that stretches over the top of the crossbar of the goal. As shown, the upper part of nettings 126 and 136 may include a single upper cord 138, pole or strap, similar to a strip on a tennis net to provide additional support to the top of the netting and keep it taught. It will be understood that nettings 126 on both corner panels 120 and 136 on the center panel 130 may be continuous with each other, and also with side panels 110 so that a single web is used for the whole training device. Alternatively, each of these nettings may be formed separately from others and separately coupled to the surrounding arms.

FIGS. 4A-C illustrate the opening of the side panels in greater detail. As shown from these top views, side panels are being progressively expanded by rotating them in the direction "A". Transverse member 114 is substantially perpendicular to crossbar 14 and base 17 in the collapsed condition (FIG. 4A), and substantially parallel with the crossbar 14 and base 17 in an expanded condition (FIG. 4C). Further expansion may be achieved to position the transverse member 114, and with it the side panels at an angle with the goal, to be effective in blocking certain angled shots. The side panels may also be disposed at any position between the collapsed and expanded conditions as shown in FIG. 4B, and in some cases, a stake, corkscrew, rope, weighted component, locking hinge and/or other means may be used secure the side panel to the ground at that angled position. Thus, side panels may be angled at any angle shown by "$\alpha$1" in FIG. 4C with respect to the goal. As shown, a portion of hinge 113 is disposed on first arm 112*a*, and a second portion of hinge 113 is disposed on the side of post 12 that is further from the crossbar. Thus, side panels 110 may be actuated and opened in this manner.

FIG. 5 illustrates one example of a contained telescoping second arm 122*a* with respect to first arm 112*a*. As shown, second arm 122*a* may be at least partially or fully housed within hollow first arm 112*a*. First arm 112*a* may include a longitudinal slot 150 extending along a portion of its length, the slot 150 being in communication with a plurality of laterally-extending gates 152 spaced a predetermined distance from one another. Each gate leads to a secure locking position 154. Any number of gates and locking pins may be used. In at least some examples, equidistant gates are used. For examples, gates may be disposed 1/3, 2/3 and 3/3 of the way along the first arms so that the height of the corner panels off the ground can be adjusted as desired. Additionally, having multiple gates will make collapsing and expanding the corner panels easier. A pin 160 may be coupled to second arm 122*a* such that movement of pin 160 moves the second arm. Pin 160 may freely slide within longitudinal slot 150 to determine the extent to which the second arm protrudes from the first arm. To lock the second arm with respect to the first arm, the user may slide the pin 160 into one of gates 152 and into the respective locking position 154. By selecting one of the gates, the user may raise the panels to a predetermined position and thereby select the heights of the training device. For example, when children are playing, the corner panels may not need to be fully extended. On the other hand, the upper-most gate may be selected for adult and youth players. In at least some example, the user may sequentially raise the pin one gate at a time to gradually raise the side panels, switching between the side panels. This may be used to ease tension in the netting, which may limit the difference in height between the two corner panels during deployment/extension. Alternatively, multiple users may simultaneously raise the pins 160 on each of the side panels to bring the corner panels 120 up and with them the center panel 130 to the expanded condition. Knobs or handles may also be used to actuate the telescoping components.

It will be understood that training device 100 may be bolted on or otherwise coupled to an existing goal post. Alternatively, training device 100 may be unitarily formed with goal post 10 and sold as a unit. Once installed, training device 100 need not be removed during regular game play. Instead, the device may simply be collapsed so as not to cause interference or significantly alter the appears of a regular goal.

In one embodiment, the posts and the first arms are formed into a single shape. Specifically, as shown in FIG. 6, post 602 may have a semicircular cross-section, and first arm 612 may have a similar semicircular cross-section so that the post and the first arm together form a circular cross-section. A hinge 613 may couple the post and the first arm together. Second arm 622 may also be semicircular and may be nested within first arm 612. In this embodiment, the first and second arms may be essentially hidden in the collapsed condition, keeping them away from view and reducing the chance that they obstruct a player or the ball during regular gameplay when the training device is stowed away.

Thus, the present disclosure provides training devices that are collapsible and expandable into two conditions: one for storage and another for use. Once installed, no additional elements or tools are necessary to actuate the device, and any adult or supervised child is able to use the device. Moreover, no heavy solid components need be uninstalled, removed or carried away during gameplay.

Additional features may be added to a soccer goal, in addition to those discussed above, or instead of them to allow for more efficient training. For example, FIGS. 7A-C shows a soccer goal 700 having a translating rear panel 720. Specifically, soccer goal 700 may have a conventional shape of uprights goal posts 712 and a cross-bar 714 forming a forward opening. A pair of side rails 716,718 are disposed on either of the goal 700. The netting covering the top and side panels is not shown for clarity. Goal 700 may further include a closed-shape (e.g., rectangular) rear panel 720 having side limbs 722, an upper limb 724, and an optional lower limb 726. The area of the rear panel 720 may be shrouded by a covering structure 730, such as a netting. In one example, the netting of the rear panel is separate from other netting of the goal to make translation simple. In some embodiments, the netting of the rear panel is taut so that balls kicked at the netting ricochet back into the playing area. Alternatively, rear panel may be covered by a board or other rigid structure instead of a netting.

As shown in FIG. 7A, rear panel 720 is disposed in a first rear-most "open" position and may be translatable or moveable relative to the other structures of the goal 700 toward the front of the goal in the direction of arrows "F". It will be understood that the opposite is also true and that the rear panel may be moved in the opposite direction of arrows "F". An optional central post 721 may be used to help move the rear panel forward and backward. Additional components, such as a strap or handle as well as rollers, wheels, bearings, a non-stick material and/or pins may be used to help in the translation of the rear panel.

In FIG. 7B, rear panel 720 has translated approximately halfway along side rails 716,718 to a second position. To aid in translation of the rear panel, each of side rails 716,718 may include a track 717 for receiving a portion of the rear panel (e.g., a portion of any of limbs 722,724,736). Optionally, a wheel 730 may be attached to the limbs to help the limbs move along the track. These elements may be included only at the top of the rear panel, the bottom of the rear panel, or at both the top and bottom of the rear panel.

As the rear panel 720 continues to translate, it may reach the forward-most position shown in FIG. 7C. At this "closed" position, the rear panel 720 may serve to block all shots from entering the interior of the goal. In at least some examples, the rear panel is capable of translating along the entire length of the side rails (e.g., 5-10 feet). Additionally, by having a taut netting or other rigid covering, a ball can ricochet off the rear panel and roll back into the field of play, reducing the time it takes the players to recover the ball after a shot.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A goal having training features, comprising:
a pair of posts;
a crossbar extending between the pair of posts;
a pair of side rails; and
a moveable rear panel having side limbs, an upper limb and a covering including a rigid board, the moveable rear panel being coupled to at least one of the pair of posts, the crossbar, and the pair of side rails.

2. The goal of claim 1, wherein the pair of side rails are orthogonal to the pair of posts.

3. The goal of claim 1, wherein the pair of side rails are orthogonal to the crossbar.

4. The goal of claim 1, wherein the pair of side rails are orthogonal to both the pair of posts and the crossbar.

5. The goal of claim 1, wherein the moveable rear panel further comprises a lower limb connecting the side limbs and parallel with the upper limb.

6. A goal having training features, comprising:
a pair of posts;
a crossbar extending between the pair of posts;
a pair of side rails; and
a moveable rear panel having side limbs, an upper limb, a covering, and a lower limb connecting the side limbs and parallel with the upper limb, the moveable rear panel being coupled to at least one of the pair of posts, the crossbar, and the pair of side rails, wherein the pair of side rails include tracks, and the rear panel comprises wheels that move along the tracks.

7. A goal having training features, comprising:
a pair of posts;
a crossbar extending between the pair of posts;
at least one side rail; and a moveable rear panel having side limbs, an upper limb and a covering the moveable rear panel being configured and arranged to translate along the at least one side rail.

8. The goal of claim 7, wherein the moveable rear panel is configured and arranged to vary a depth of the goal, the depth of the goal being defined as a distance between the crossbar and the upper limb.

9. The goal of claim 8, wherein the depth of the goal may be selected from between 0 feet and 5 feet.

* * * * *